US006464346B2

(12) United States Patent
Otis, Jr. et al.

(10) Patent No.: US 6,464,346 B2
(45) Date of Patent: Oct. 15, 2002

(54) INK CONTAINMENT AND DELIVERY TECHNIQUES

(75) Inventors: David R. Otis, Jr.; Charles R. Steinmetz; John F. Wilson; David Olsen, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/817,084

(22) Filed: Mar. 26, 2001

(65) Prior Publication Data

US 2002/0008744 A1 Jan. 24, 2002

Related U.S. Application Data

(63) Continuation-in-part of application No. 09/430,400, filed on Oct. 29, 1999.

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS

| | | | | |
|---|---|---|---|---|
| 5,719,609 A | 2/1998 | Hauck et al. | ..... | 347/85 |
| 5,777,646 A | 7/1998 | Barinaga et al. | ..... | 347/86 |
| 5,992,990 A | 11/1999 | Childers et al. | ..... | 347/87 |
| 6,084,617 A | 7/2000 | Balazer | ..... | 347/86 |
| 6,137,513 A | 10/2000 | Pawlowski, Jr. et al. | ..... | 347/86 |
| 6,164,742 A | 12/2000 | Hauck | ..... | 347/6 |
| 6,164,766 A | 12/2000 | Erickson | ..... | 347/85 |

FOREIGN PATENT DOCUMENTS

| | | | | |
|---|---|---|---|---|
| EP | 0756935 A2 * | 2/1997 | ..... | B41J/2/175 |
| EP | 0803362 A2 | 10/1997 | | |
| EP | 0899112 A2 * | 3/1999 | ..... | B41J/2/175 |
| EP | 0904940 A2 | 3/1999 | | |
| EP | 0941854 A2 | 9/1999 | | |
| EP | 1063090 A2 | 12/2000 | | |
| JP | 2000343723 | 12/2000 | | |

OTHER PUBLICATIONS

PCT International Search Report dated Jul. 4, 2002, for related case PCT/US02/06202.

* cited by examiner

*Primary Examiner*—Anh T. N. Vo

(57) ABSTRACT

An ink containment and delivery system provides high sustained flow rates, allows higher "burst" (short time interval) flow rates, and allows bubble movement through the system conduits to the printhead, all while holding the printhead ink pressure in a range required for optimum printhead operation. The system includes an ink supply with a first, upstream pressure regulator which maintains a negative ink pressure within the ink supply. A second, downstream pressure regulator at the printhead maintains negative pressure in the printhead, and allows some compliance about the set point. The ink containment and delivery system allows drool-free separability of the ink supply and the printhead.

26 Claims, 6 Drawing Sheets

INK CONTAINMENT AND DELIVERY TECHNIQUES

CROSS-REFERENCE TO RELATED APPLICATION

This application is a continuation-in-part of application Ser. No. 09/430,400, filed Oct. 29, 1999, entitled INK RESERVOIR FOR AN INKJET PRINTER.

BACKGROUND OF THE INVENTION

This invention relates to inkjet printing, and more particularly to ink containment and delivery systems.

Inkjet printing systems frequently make use of an inkjet printhead mounted to a carriage which is moved back and forth across a print media, such as paper. As the printhead is moved across the print media, control electronics activate an ejector portion of the printhead to eject, or jet, ink droplets from ejector nozzles and onto the print media to form images and characters. An ink supply provides ink replenishment for the printhead ejector portion.

Some printing systems make use of an ink supply that is replaceable separately from the printhead. When the ink supply is depleted, the ink supply is removed and replaced with a new ink supply. The printhead is then replaced at or near the end of printhead life and not when the ink supply is depleted. When a replaceable printhead is capable of utilizing a plurality of ink supplies, this will be referred to as a "semipermanent " printhead. This is in contrast to a disposable printhead, that is replaced with each container of ink.

To operate properly, many printheads must be maintained within a narrow range of slightly negative gauge pressure, typically between −3 and −12 inches of water. Gauge pressure refers to a measured pressure relative to atmospheric pressure. Pressures referred to herein will all be gauge pressures. If the pressure becomes positive, printing and ink containment within the printhead will be adversely affected. During a printing operation, positive pressure can cause drooling and halt ejection of droplets. During storage, positive pressure can cause the printhead to drool. Ink that drools during storage can accumulate and coagulate on printheads and printer parts. This coagulated ink can permanently impair droplet ejection of the printhead and result in a need for costly printer repair. To avoid positive pressure, the printhead makes use of an internal mechanism to maintain negative pressure.

Air present in a printhead can interfere with the maintenance of negative pressure. When a printhead is initially filled with ink, air bubbles are often present. In addition, air accumulates during printhead life from a number of sources, including diffusion from outside atmosphere into the printhead and dissolved air coming out of the ink referred to as outgassing. During environmental changes, such as temperature increases or pressure drops, the air inside the printhead will expand in proportion to the total amount of air contained. This expansion is in opposition to the internal mechanism that maintains negative pressure. The internal mechanism within the printhead can compensate for these environmental changes over a limited range of environmental excursions. Outside of this range, the pressure in the printhead will become positive.

Moreover, if excessive air enters the printhead, this air can block air flow to the nozzles, interfering with drop ejection, and so degrading image quality.

SUMMARY OF THE INVENTION

An ink containment and delivery system in accordance with aspects of the invention provides high sustained flow rates, allows higher "burst" (short time interval) flow rates, and allows bubble movement through the system conduits to the printhead, all while holding the printhead ink pressure in a range required for optimum printhead operation. The ink containment and delivery system allows drool-free separability of the ink supply and the printhead.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF EXEMPLARY EMBODIMENTS

Figure 1:
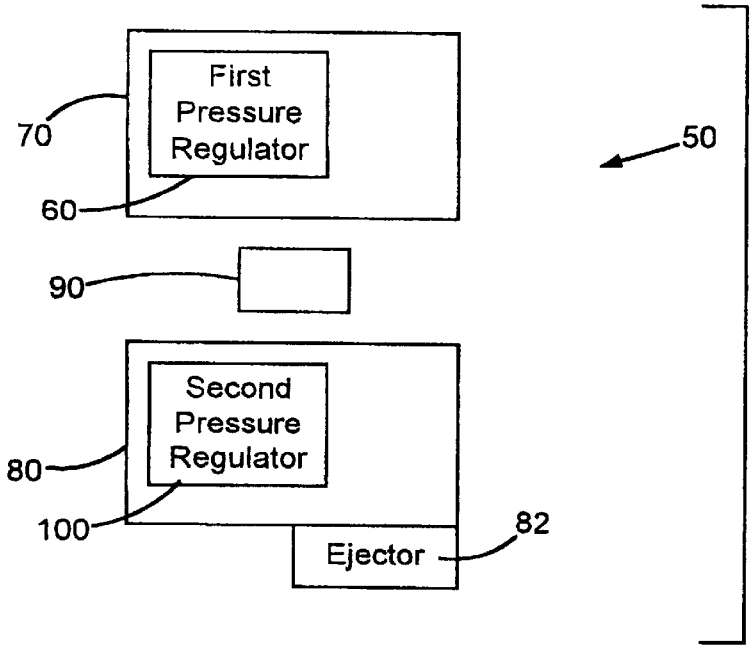
FIG. 1 is a schematic diagram of a dual regulator, ink delivery system with two pressure regulators in series.

FIG. 1 schematically illustrates a dual regulator, ink delivery system 50 with two pressure regulators in series. The first pressure regulator 60 is located in a replaceable ink supply 70 that is fluidically coupled to a printhead 80 via a fluid coupler 90 to provide an ink path to the printhead 80. The second pressure regulator 100 is located in the printhead 80. The second pressure regulator 100 accurately maintains the printhead pressure range to optimize printhead performance. The second pressure regulator also has a "two direction" accumulator function, with a first direction to prevent printhead drooling and a second direction to provide an ink buffer for high-flow rate "burst" printing.

This is a non-active, or passive, ink delivery system, in that there are no active pumps used to deliver ink from the ink supply to the printhead; only the negative pressure provided by the printhead is used to draw ink from the ink supply.

In an exemplary embodiment, the second pressure regulator 100 is a mechanical device with spring-loaded, lung-like air bags which maintain a set printhead pressure, gage pressure minus "x", where, e.g., x is −5 inches of water. Printhead regulators suitable for the second pressure regulator 100 are described in U.S. Pat. No. 6,137,513, and in U.S. Pat. No. 6,164,742, the entire contents of which patents are incorporated herein by this reference.

Figure 7:
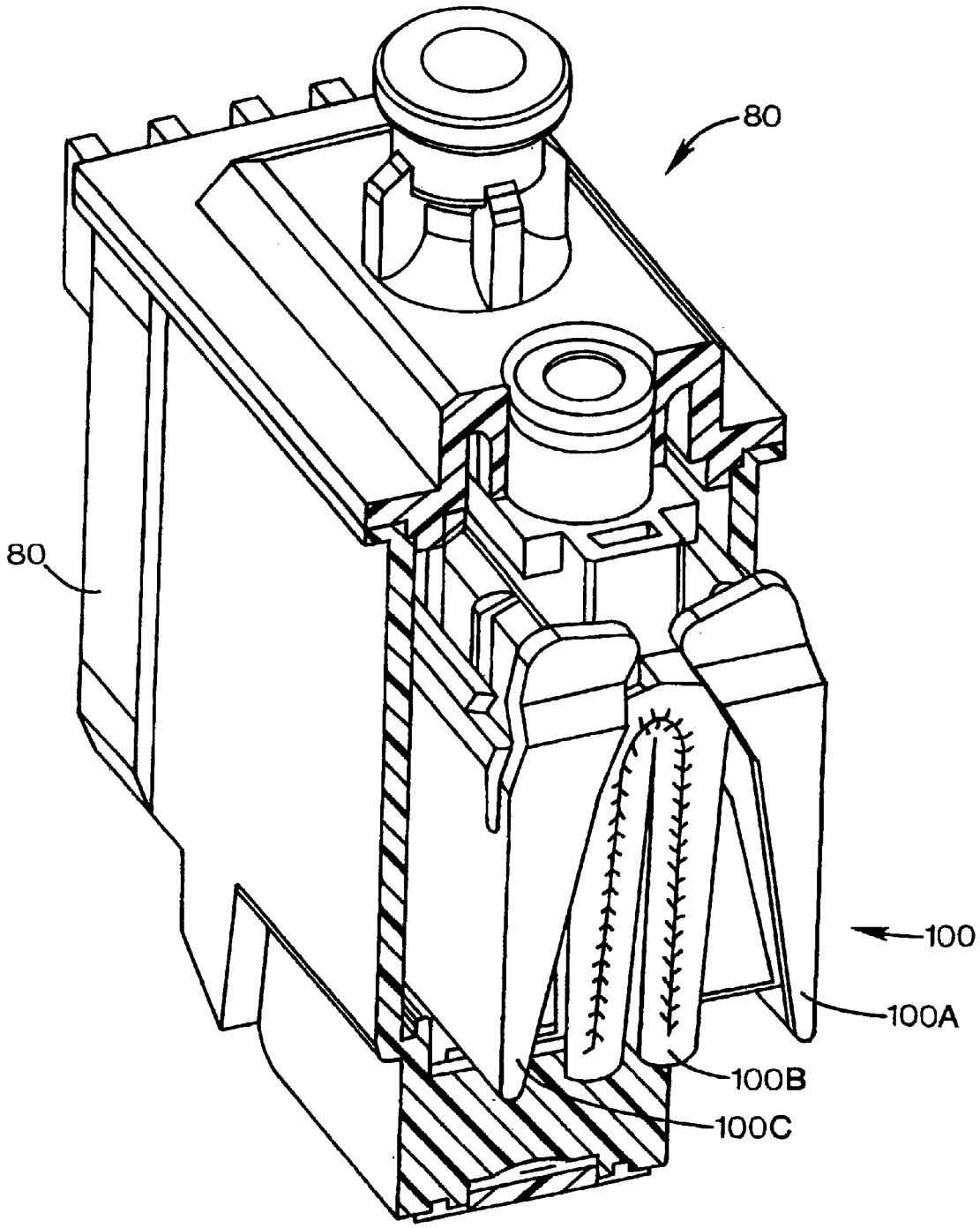
FIG. 7 is a cutaway view illustrating aspects of an exemplary internal pressure regulator for the printhead cartridge.

FIG. 7 illustrates a printhead or print cartridge 80 including a regulator 100 (FIG. 7 generally corresponds to FIG. 18 of U.S. Pat. No. 6,137,513). The printhead 80 includes a housing 80A. Disposed within the housing are elements of the regulator 100, including a pressure regulator lever 100B, an accumulator lever 100A, and a flexible bag 100C. The levers are urged together by a spring (not shown in FIG. 7). In opposition to the spring, the bag spread the two levers apart as it inflates outward. The regulator lever controls the state of a valve which controls the flow of ink into the internal printhead ink reservoir from the fluid interconnect. Further details regarding the regulator 100 are provided in U.S. Pat. No. 6,137,513.

In the absence of compliance "below the set point" by regulator 100, an increase in temperature could cause an air bubble in the printhead to expand, causing the pressure in the printhead to rise to positive gage pressure, e.g. 7 inches of water, pushing ink out the printhead nozzles. Built-in compliance, supplied by the lung-like bag 100C of the downstream regulator 100, absorbs the effect of such expanding bubbles, and keeps the pressure in the printhead negative, e.g . the pressure will rise to −2 inches of water, and so prevents ink drool from the nozzles.

Compliance "above the set point" of the regulator 100 assures that when a print job requires a high flow rate from the nozzles that the ink supply cannot deliver for long intervals, e.g. 6 cc ink/minute for an exemplary application, unless unacceptably low pressures (e.g. less than about −12 inches of water) are generated at the printhead, such delivery rates are allowed for short intervals without exceeding printhead back pressure limits because of compliance in the regulator spring-loaded bags. This "fluidic compliance" is analogous to electrical capacitance, which allows high currents of short duration when a power supply cannot sustain such high currents. The second regulator pressure-volume curve has finite compliance for pressures above and below its "set point." The "set point" is the gage pressure to which the second regulator tends after flow through the printhead stops, provided sufficient pressure is applied to the second regulator.

An exemplary burst interval for high-rate burst printing in one embodiment is 0.24 seconds, the time required for one pass of the printhead carriage over the print medium in an exemplary printing system. For this example, during this short burst, 0.03 cc ink is ejected from the printhead. The resulting burst flowrate is equivalent to 0.03 cc/0.24 seconds, or 0.12 cc/seconds. This is a flow rate of 7.2 cc per minute for this exemplary burst.

Figure 2:
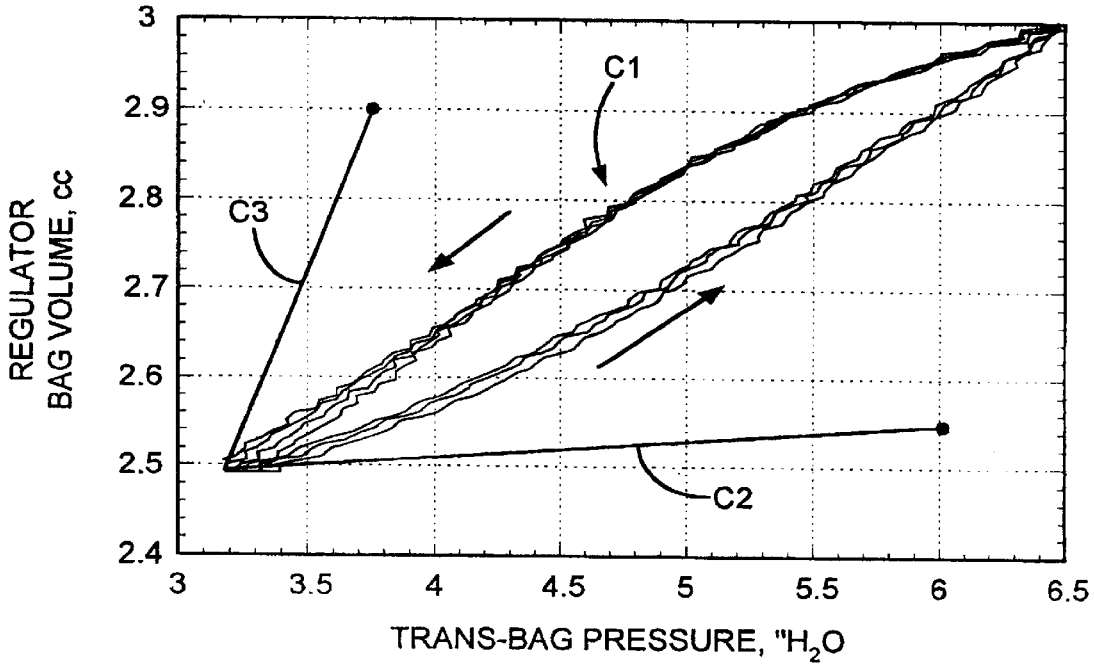
FIG. 2 is a graph illustrating regulator compliance for downstream pressure regulation in an inkjet printhead.

FIG. 2 is a graph of regulator pressure-volume illustrating downstream regulator compliance about the regulator set point. For an exemplary pressure regulator with spring-loaded, lung-like air bags which maintain a set printhead pressure, a set point could be −4.5 inches of water. FIG. 2 shows the regulator bag volume (cc) as a function of the pressure outside the bag and within the printhead, which is equal to the pressure within the bag (0 gage pressure) minus the pressure outside the bag and within the printhead. A perfect pressure regulator would be a vertical line, i.e. maintaining a constant pressure as the regulator bag volume changes to accommodate air bubbles and heavy ink usage demands. Loop C1 illustrates a useful compliance of the regulator in the vicinity of the set point at −4.5 inches of water. In this exemplary embodiment, the mean slope of the loop C1 is the regulator compliance, and is equal to 0.15 cc/"H2O for this example. In a physical system, there will be some hysteresis in the volume-pressure relationship as the negative pressure increases and then subsides, and this is illustrated in loop C1. Line C2 illustrates a hypothetical pressure-volume relationship with low compliance, with a small change in regulator bag volume resulting in a large change in the printhead pressure. Line C3 illustrates a hypothetical pressure-volume relationship with high regulator compliance, closer to the ideal regulator compliance than even compliance C1, with a relatively large change in the regulator bag volume to produce only a relatively small change in the pressure.

The first pressure regulator 70 in the ink supply 60 maintains a negative gage pressure in the ink supply to prevent ink supply drooling, but this pressure is not so negative that the second pressure regulator cannot draw ink from it at rates required by the printhead. In an exemplary embodiment, the first pressure regulator 70 is a body of capillary material such as bonded polyester fiber, as described in commonly assigned U.S. application Ser. No., 09/430,400, the entire contents of which are incorporated herein by this reference. The first pressure regulator will typically provide a negative pressure at the fluid outlet port of the ink supply in a range between about −1 inches of water and −10 inches of water, and more preferably in a range between about −2 inches of water and —10 inches of water.

In an exemplary embodiment, the fluid coupler 90 is a rigid tube assembly or manifold of course, other devices could also be employed as the fluid coupler, e.g. a flexible tubing. The connections between the ink supply and fluid coupler can be made using the self-sealing fluid interconnect described in U.S. Pat. No. 5,777,646, the entire contents of which are incorporated herein by this reference. Another suitable fluid coupling technique is illustrated in pending applications Ser. No. 09/747,241, filed Dec. 22, 2000, the entire contents of which are incorporated herein by this reference.

Positioning the first regulator 70 above the second regulator 100 in a gravity field has the performance advantage of the extra hydrostatic pressure enabling higher flow rates within the given printhead pressure constraints. This is because the extra pressure hastens flow into the second (downstream) pressure regulator, helping it keep up with drop ejection; reducing the degree to which such inflow lags the outflow through the nozzles reduces the dynamic pressure range in the printhead. Minimizing this pressure range optimizes drop ejection and print quality. The relative altitude positioning of the two regulators allows for printhead pressure to be tuned.

In an exemplary embodiment, where the inks have a viscosity on the order of 3 cp (centipoise) and below, the compliance for the second regulator in the vicinity of the set point is approximately 0.15 cc/"$H_2O$, and the set point is approximately −5 " $H_2O$. For the first regulator, the set point is approximately −4" $H_2O$. The first regulator is positioned approximately 2.5 inches above the nozzles on the printhead in an exemplary embodiment. The flow resistance through the containment and delivery system is such that it can provide sustained ink flow rates as high as 1.5 cc/min, and "burst" flow up to five times higher, for inks with viscosities of 3 cp and below. For optimum performance, the system must maintain the printhead pressure in the range between approximately −3 and −12 inches $H_2O$. Of course, the invention is not limited to ink delivery systems having the foregoing parameter values, and will also be suitable for systems having different pressures, viscosities, compliances and other parameters.

For systems with pressure regulation only in the ink supply, when the supply is removed and there is some air trapped in the printhead, environmental changes can cause ink to drool from the printhead. In accordance with aspects of this invention, as compared to systems employing only a pressure regulator in the ink supply, printhead drooling is prevented when the first regulator is detached. More accurate printhead pressure regulation is provided since the pressure is regulated closest to the printhead, with minimal intervening flow resistances. Further, the first regulator can be a consumable item which need not have significant compliance or precise pressure control.

In accordance with further aspects of the invention, as compared to systems having only a pressure regulator in the printhead, printhead drooling is prevented when the ink supply is detached. Pressure regulation in the supply enables a lower cost fluid coupler that does not need to be self sealing. If there was no pressure regulation in the supply, and the pressure in the supply became positive, then removing the supply from the rest of the system would result in an ink mess. A lower cost, less complex method of venting the ink supply to atmosphere can be provided, such as, by way of example, the system described in U.S. Pat. No. 5,010,354, the entire contents of which are incorporated herein by this reference.

If the second pressure regulator 100 did not have compliance above the set point, then the printhead pressure range during burst printing will be unacceptably high. If the second regulator has minimal internal volume, then air management will be difficult, in that little space is available to warehouse air.

Other non-pressurized ink delivery systems can require primers or pumps downstream of the printhead to move bubbles through the system to a position where they are rendered harmless. As compared to such systems, an ink delivery system, including the fluid coupler, in accordance with aspects of this invention, can be designed so that the printhead can exert sufficient pressure to move bubbles to the printhead where the air is warehoused. No additional pump is required. Thus, the pressure differences between the second (downstream) pressure regulator and the first (upstream) regulator are high enough to move bubbles downstream. In such a system, the bubbles end up "warehoused " in the printhead.

Figure 3:
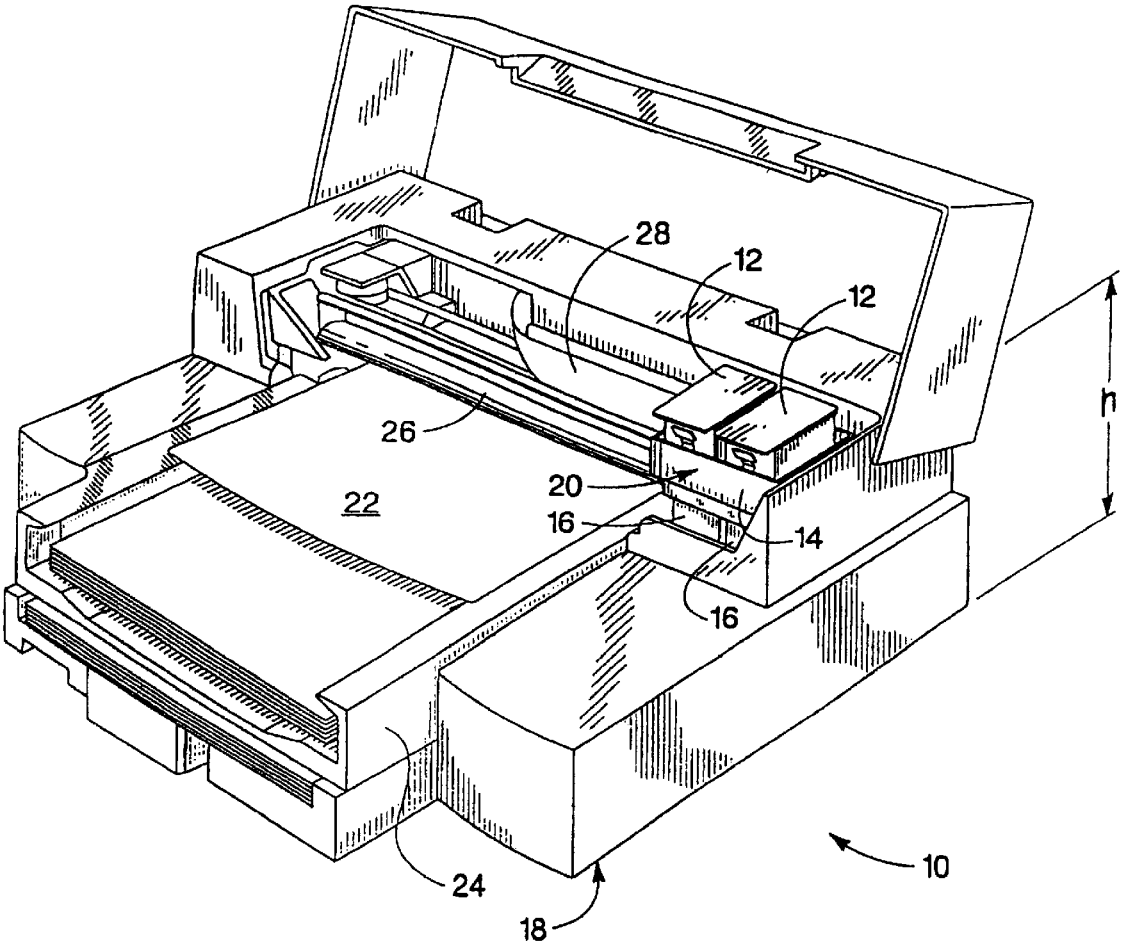
FIG. 3 illustrates one exemplary embodiment of an ink jet printing system of the present invention shown with a cover opened to show a plurality of replaceable ink containers, and which can employ a dual regulator ink delivery system in accordance with aspects of this invention.

In an exemplary embodiment of a printing system embodying aspects of this invention, the first (upstream) pressure regulator is provided by a capillary medium, such as bonded polyester fiber (BPF) as described above. The second (downstream) regulator 100 is a "clamshell type " regulator of the type described in U.S. Pat. No. 6,137,513. FIG. 3 is a perspective view of one such exemplary embodiment of a printing system 10, shown with its cover open, that includes at least one replaceable ink container 12 that is installed in a receiving station 14. With the replaceable ink container 12 properly installed into the receiving station 14, ink is provided from the replaceable ink container 12 to at least one ink jet printhead 16. The ink jet print cartridge 16 includes a small ink reservoir and an ink jet nozzle array 17 (FIG. 4), that is responsive to activation signals from a printer portion 18 to deposit ink on print media. As ink is ejected from the nozzle array 17, the printhead 16 is replenished with ink from the ink container 12.

The printhead 16 further includes a second pressure regulator 100, as described above regarding FIG. 1. In an exemplary embodiment, the pressure regulator is a "clamshell" type regulator as described in U.S. Pat. No. 6,137,513.

In an illustratative embodiment, the replaceable ink container 12, the receiving station 14, and the ink jet printhead 16 are each part of a scanning print carriage 20 that is moved relative to a print media 22 to accomplish printing. Alternatively, the ink jet printhead is fixed and the print media is moved past the printhead to accomplish printing. The printer portion 18 includes a media tray for receiving print media 22. As print media 22 is stepped through the print zone, the scanning carriage moves the printhead relative to the print media 22. The printer portion 18 selectively activates the printhead 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

A method and apparatus is provided for inserting the ink container 12 into the receiving station 14 such that the ink container 12 forms proper fluidic and electrical interconnect with the printer portion 18. The fluidic interconnection allows a supply of ink within the replaceable ink container 12 to be fluidically coupled to the printhead 16 for providing a source of ink to the printhead 16. The electrical interconnection allows information to be passed between the replaceable ink container 12 and the printer portion 18. Information passed between the replaceable ink container 12 and the printer portion 18 can include information related to the compatibility of replaceable ink container 12 with printer portion 18 and operation status information such as the ink level information, to name some examples.

Figure 4:
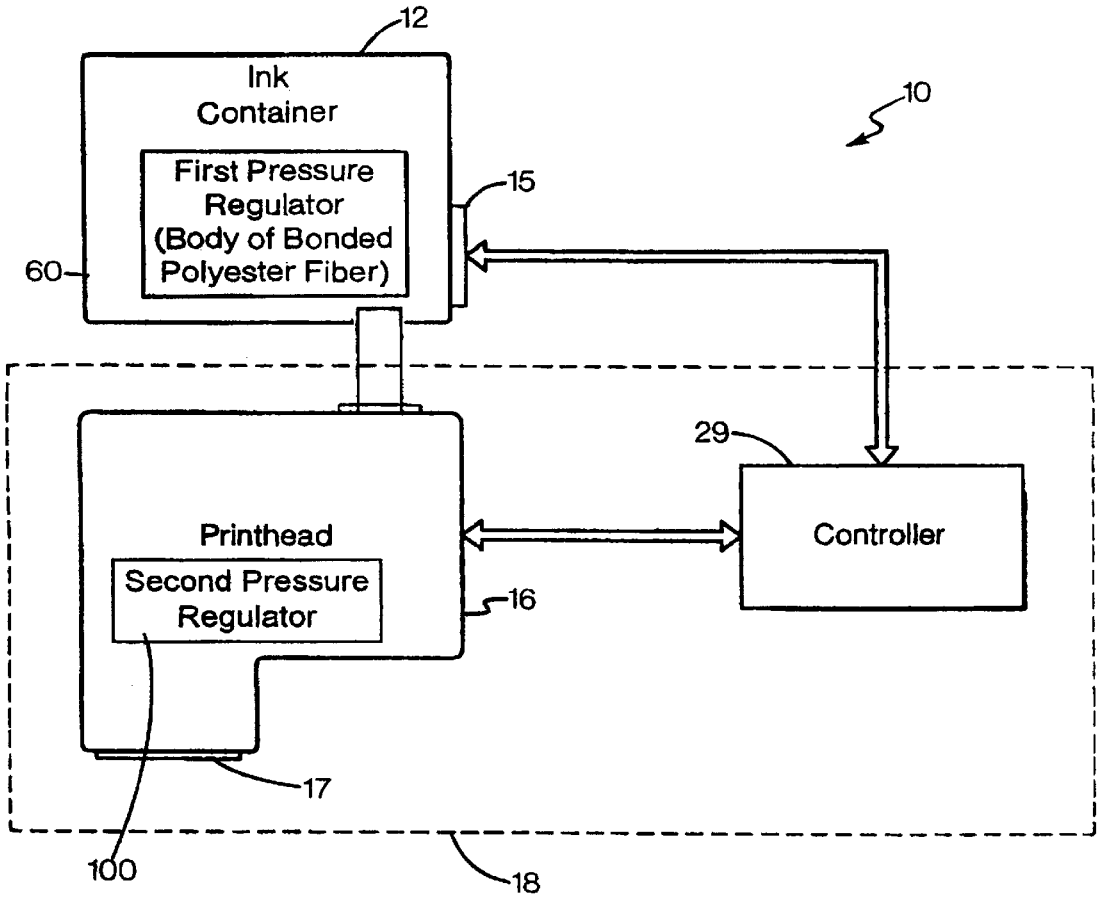
FIG. 4 is a schematic representation of the inkjet printing system shown in FIG. 3.

FIG. 4 is a simplified schematic representation of the inkjet printing system 10 shown in FIG. 3. FIG. 4 is simplified to illustrate a single printhead 16 connected to a single ink container 12. The inkjet printing system 10 includes the printer portion 18 and the ink container 12, which is configured to be received by the printer portion 18. The printer portion 18 includes the inkjet printhead 16 and a controller 29. With the ink container 12 properly inserted into the printer portion 18, an electrical and fluidic coupling is established between the ink container 12 and the printer portion 18. The fluidic coupling allows ink stored within the ink container 12 to be provided to the printhead 16. The electrical coupling allows information to be passed between an electrical storage device 15 disposed on the ink container 12 and the printer portion 18. The exchange of information between the ink container 12 and the printer portion 18 is to ensure the operation of the printer portion 18 is compatible with the ink contained within the replaceable ink container 12 thereby achieving high print quality and reliable operation of the printing system 10.

The controller 29, among other things, controls the transfer of information between the printer portion 18 and the replaceable ink container 12. In addition, the controller 29 controls the transfer of information between the printhead 16 and the controller 29 for activating the print cartridge to selectively deposit ink on print media. In addition, the controller 29 controls the relative movement of the printhead 16 and print media. The controller 29 performs additional functions such as controlling the transfer of information between the printing system 10 and a host device such as a host computer (not shown).

Figure 5:
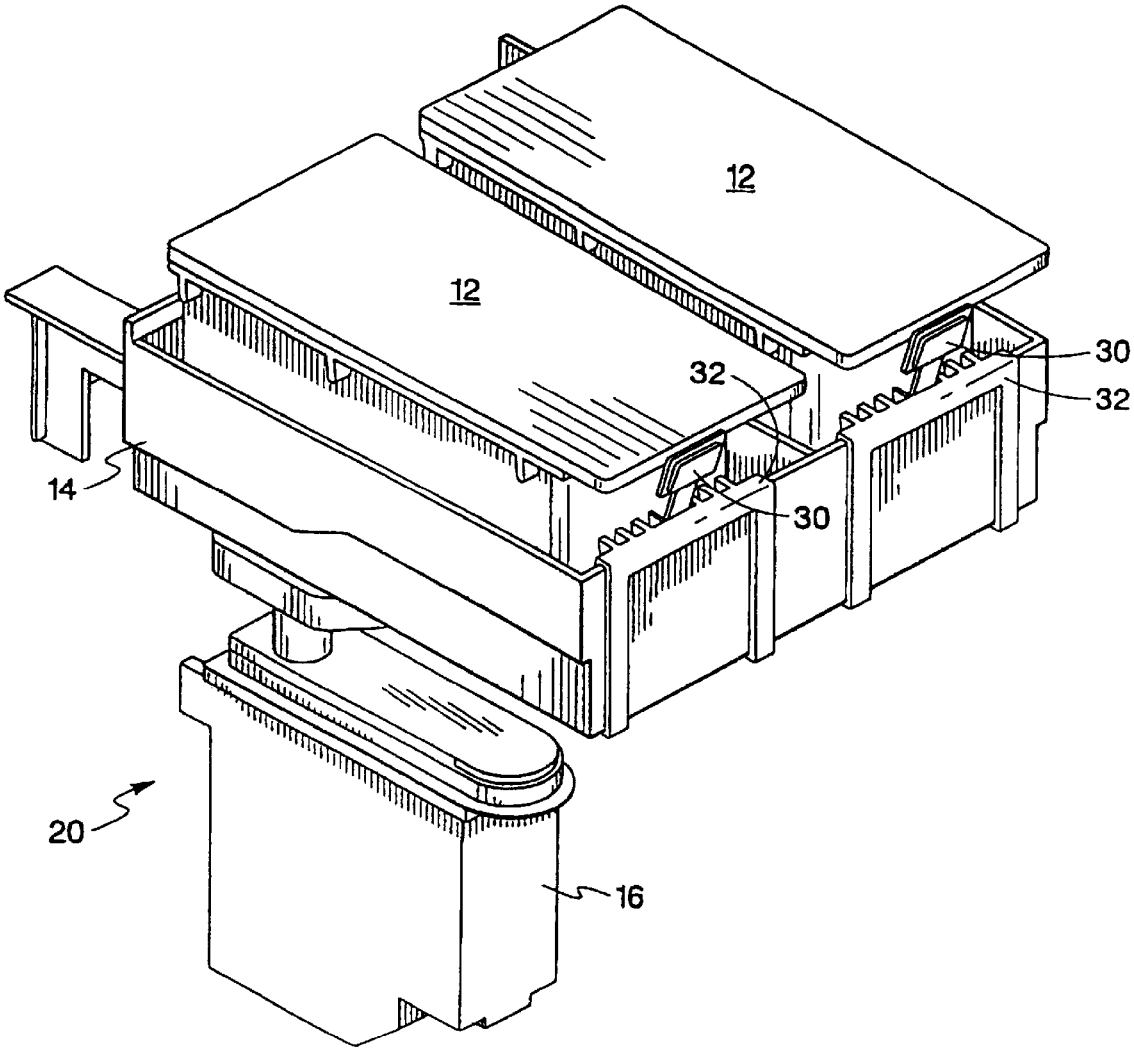
FIG. 5 is a greatly enlarged perspective view of a portion of a scanning carriage showing the replaceable ink containers of the present invention positioned in a receiving station that provides fluid communication between the replaceable ink containers and one or more printhead.

FIG. 5 is a perspective view of a portion of the scanning carriage 20 showing a pair of replaceable ink containers 12 properly installed in the receiving station 14. An inkjet printhead 16 is in fluid communication with the receiving station 14. In an exemplary embodiment, the inkjet printing system 10 includes a tricolor ink container containing three separate ink colors and a second ink container containing a single ink color. In this embodiment, the tri-color ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

In an exemplary embodiment, four inkjet print printheads 17, one mounted to a cartridge for printing black ink, and three mounted to a tri-color cartridge for printing cyan, magenta and yellow, are each fluidically coupled to the receiving station 14. In this exemplary embodiment, each of the four printheads is fluidically coupled to one of the four colored inks contained in the replaceable ink containers. Thus, the cyan, magenta, yellow and black printheads 17 are each coupled to their corresponding cyan, magenta, yellow and black ink supplies, respectively. Other configurations which make use of fewer printheads than four are also possible. For example, the printheads 16 can be configured to print more than one ink color by properly partitioning the nozzle array 17 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing.

In another exemplary embodiment, four printheads each with a nozzle array can be employed, with four replaceable ink containers, and with each cartridge fluidically coupled to one of the four colored inks contained in the replaceable ink containers. Thus, for this alternate embodiment, the cyan, magenta, yellow and black printheads are each coupled to their corresponding cyan, magenta, yellow and black ink supplies, respectively.

The scanning carriage portion 20 shown in FIG. 5 is shown fluidically coupled to a single printhead 16 for simplicity. Each of the replaceable ink containers 12 include a latch 30 for securing the replaceable ink container 12 to the receiving station 14. The receiving station 14 in the preferred embodiment includes a set of keys 32 that interact with corresponding keying features (not shown) on the replaceable ink container 12. The keying features 10 on the replaceable ink container 12 interact with the keys 32 on the receiving station 14 to ensure that the replaceable ink container 12 is compatible with the receiving station 14.

Figure 6:
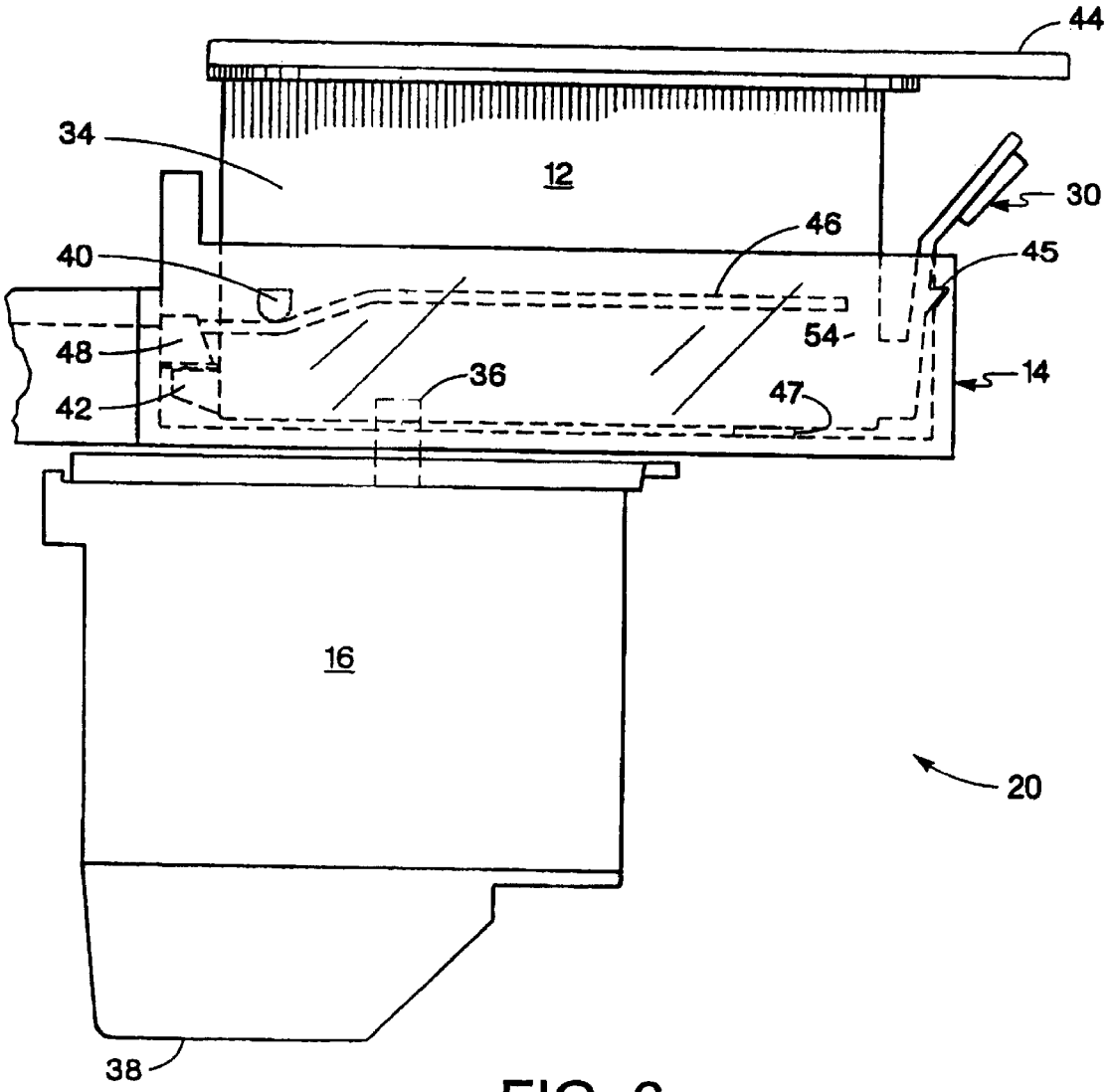
FIG. 6 is a side plan view of a portion of the scanning carriage.

FIG. 6 is a side plan view of the scanning carriage portion 20 shown in FIG. 5. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment the monochrome replaceable ink container 12 is a single ink reservoir 34 for containing ink of a single color.

In the preferred embodiment, the reservoir 34 has a capillary storage member disposed therein, which acts as the first pressure regulator 60. The capillary storage member has the properties described above regarding regulator 60 and FIG. 1. The preferred capillary storage member is a network of heat bonded polymer fibers described in U.S. Patent Application entitled "Ink Reservoir for an Inkjet Printer," filed Oct. 29, 1999, Ser. No. 09/430,400, assigned to the assignee of the present invention and incorporated herein by reference. Other types of capillary material could alternatively be employed, such as foam.

Once the ink container 12 is properly installed into the receiving station 14, the ink container 12 is fluidically coupled to the printhead 16 by way of fluid interconnect 36. Upon activation of the printhead 16, ink is ejected from the printhead 17 producing a negative gauge pressure, sometimes referred to as backpressure, within the printhead 16. This negative gauge pressure within the printhead 16 is sufficient to overcome the capillary force resulting from the capillary member disposed within the ink reservoir 34. Ink is drawn by this backpressure from the replaceable ink container 12 to the nozzle array 17. In this manner, the nozzle array 17 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 6. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. The ink container 12 is properly positioned within the receiving station 14 such that proper compression of the capillary member is accomplished when the ink container 12 is inserted into the receiving station. Proper compression of the capillary member establishes a reliable flow of ink from the ink container 12 to the printhead 16. The ink container 12 includes a screen disposed across the fluid outlet. The fluid interconnect 36 engages the screen when inserted into the fluid outlet.

The replaceable ink container 12 further includes a guide feature 40, an engagement feature 42, a handle 44 and a latch feature 30 that allow the ink container 12 to be inserted into the receiving station 14 to achieve reliable fluid interconnection with the printhead 16 as well as form reliable electrical interconnection between the replaceable ink container 12 and the scanning carriage 20.

In this exemplary embodiment, the receiving station 14 includes a guide rail 46, an engagement feature 48 and a latch engagement feature 45. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 47 associated with the receiving station 14 until a latch engagement feature 50 associated with the receiving station 14 engages a hook feature 54 associated with the latch member 30 to secure a back end or trailing end of the ink container 12 to the receiving station 14.

In another embodiment employing aspects of this invention, the first (upstream) pressure regulator 60 in the ink supply 70 as well as the second (downstream) pressure regulator 100 are fabricated as clamshell-type regulators. A third, less desirable implementation employs BPF capillary media type pressure regulators for both regulators 60 and 100. This third embodiment is less desirable because the second regulator would have minimal compliance above the set point, and no ability to warehouse in the printhead.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink containment and delivery system, comprising:

a replaceable ink supply having a first pressure regulator for maintaining a negative gage pressure within the ink supply to prevent ink supply drooling;

a printhead including an ink ejector and a second pressure regulator for maintaining a printhead ink pressure within a negative pressure range to prevent ink drool from the ink ejector and to provide an ink buffer for high-rate burst printing; and a fluid interconnect structure for establishing a fluid path between the replaceable ink supply and the printhead during printing operations.

2. The system of claim 1 wherein the second pressure regulator is characterized by a set point gage pressure to which the second pressure regulator tends after flow through the printhead stops, and by a pressure-volume relationship having finite compliance for pressures above and below said set point gage pressure.

3. The system of claim 2, wherein the second pressure regulator finite compliance for pressures above said set point gage pressure enables short interval high burst printing rates, wherein high printhead flow rates from the printhead nozzles at rates that the ink supply is unable deliver for long intervals are permitted without causing negative printhead back pressure which exceeds a predetermined limit.

4. The system of claim 3, wherein the second regulator is a mechanical device with spring-loaded, lung-like air bags.

5. The system of claim 1 wherein said ink supply is positioned above the printhead in a gravitational sense.

6. The system of claim 1 further comprising a quantity of ink disposed in said ink supply.

7. The system of claim 1 wherein ink supply includes an ink reservoir, and the first pressure regulator is a capillary structure disposed in said reservoir for generating a capillary force on ink in the reservoir, said structure including at least one continuous fiber defining a three dimensional porous member with the at least one continuous fiber bonded to itself at points of contact to form a self sustaining structure for retaining the ink.

8. The system of claim 1 wherein the first pressure regulator maintains a negative gage pressure within the ink supply to prevent ink supply drooling, but which is not so negative that the second pressure regulator cannot draw ink from the ink supply at rates required by the printhead during printing operations.

9. An inkjet printing system, comprising:

a replaceable ink container for holding a primary supply of liquid ink, the ink container comprising a containment vessel with an outlet port, and a first pressure regulator for maintaining a negative gage pressure within the ink supply to prevent ink supply drooling;

an inkjet printhead comprising a nozzle array, an internal ink reservoir, and a second pressure regulator for maintaining a printhead ink pressure within a negative pressure range to prevent ink drool from the nozzle array and to provide an ink buffer for high-rate burst printing, the second pressure regulator providing an air warehousing capacity within the internal ink reservoir while maintaining said printhead ink pressure within said negative pressure range;

a receiving station for mounting the printhead and the ink container;

a fluid interconnect structure for establishing a fluid path between the ink container and the printhead when the ink container and the printhead are installed in the receiving station.

10. The system of claim 9, wherein said first regulator comprises a body of reservoir material forming a capillary storage member for storing ink within the ink container under negative pressure.

11. The system of claim 9 wherein the second pressure regulator is characterized by a set point gage pressure to which the second pressure regulator tends after flow through the nozzle array stops, and by a pressure-volume relationship having finite compliance for pressures above and below said set point gage pressure.

12. The system of claim 11, wherein the second pressure regulator finite compliance for pressures above said set point gage pressure enables short interval high burst printing rates, wherein high printhead flow rates from the printhead nozzle array at rates that the replaceable ink container is unable deliver for long intervals are permitted without causing negative printhead back pressure which exceeds a predetermined limit.

13. The system of claim 9 wherein said replaceable ink container is positioned above the printhead in a gravitational sense when mounted in said receiving station.

14. The system of claim 9 further comprising a quantity of ink disposed in said replaceable ink container.

15. A method for ink replenishment in an inkjet printing system, comprising:

providing a replaceable ink container having an upstream pressure regulator for maintaining liquid ink within the container under negative pressure to prevent ink drool from an outlet port;

providing an inkjet printhead including a nozzle array for ejecting ink droplets and a downstream pressure regulator for maintaining a printhead ink pressure within a negative pressure range to prevent ink drool from the nozzle array and to provide an ink buffer for high-rate burst printing;

installing the printhead and the replaceable ink container in an inkjet printing system, so that an ink replenishment path is established between the outlet port of the ink container and the printhead cartridge;

activating the printhead cartridge during a printing operation to eject ink droplets from the nozzle array;

regulating the printhead ink pressure within the inkjet cartridge with the downstream pressure regulator to maintain the printhead ink pressure within a negative pressure range for producing good print quality.

16. The method of claim 15 wherein said activating the printhead includes activating the printhead for a time interval to produce high burst rate printing using a relatively large amount of ink which exceeds a replenishment rate of the ink container, and said step of regulating the printhead ink pressure includes providing some compliance preventing the negative pressure from exceeding a negative pressure limit.

17. The method of claim 15, wherein the second pressure regulator is characterized by a set point gage pressure to which the second pressure regulator tends after flow through the printhead stops, and by a pressure-volume relationship having finite compliance for pressures above and below said set point gage pressure.

18. The method of claim 15 wherein said installing the printhead and the replaceable ink container in an inkjet printing system includes:

positioning the replaceable ink container above the printhead in a gravitational sense.

19. The method of claim 15 wherein an air bubble has been formed in said replaceable ink container or in said ink replenishment path, and further comprising:

drawing the air bubble through the path into the printhead;

and wherein said regulating the printhead ink pressure within the printhead with the downstream pressure regulator includes accommodating said air bubble while maintaining the printhead pressure in said negative pressure range.

20. The method of claim 15 further comprising:

providing a supply of liquid ink in said replaceable ink container.

21. An ink delivery system, in which a printhead mounted on a scanning carriage moves across a print zone to deposit ink on media, with the printhead incorporated into a cartridge which has an internal pressure regulator that supplies ink to the printhead, the internal pressure regulator for maintaining a printhead ink pressure within a negative pressure range to prevent ink drool from the printhead and to provide an ink buffer for high-rate burst printing, the ink delivery system comprising:

an ink supply that is adapted to be removably mounted to the scanning carriage;

an ink reservoir in said ink supply that is in fluid communication with a discharge port; and ink contained in the ink reservoir which passes out of the discharge port and to the internal regulator of the printhead; and an ink supply pressure regulator for maintaining a negative pressure within said ink reservoir to prevent ink drool from said discharge port when the ink supply is disconnected from the printhead.

22. The system of claim 21, wherein said ink supply pressure regulator is a capillary member which maintains the negative pressure within the ink reservoir at the discharge port at a pressure range between −2 inches of water and −10 inches of water.

23. The system of claim 22, wherein said capillary member is a capillary structure including at least one continuous fiber defining a three dimensional porous member with the at least one continuous fiber bonded to itself at points of contact to form a self sustaining structure for retaining the ink.

24. An ink supply for use in an inkjet printer including a scanning carriage, and a printhead mounted on the carriage for movement across a print zone to deposit ink on media, the printhead incorporated into a cartridge having an internal pressure regulator that supplies ink to the printhead and maintains a printhead ink pressure within a negative pressure range to prevent ink drool from the printhead and to provide an ink buffer for high-rate burst printing, the ink supply comprising:

an ink supply housing for removable mounting to the scanning carriage;

an ink reservoir in said ink supply housing in fluid communication with a supply discharge port;

ink contained in the ink reservoir which, when the ink supply is mounted on said carriage in fluid communication with the printhead, passes out of the discharge port and to the internal pressure regulator of the printhead due to a negative pressure differential between the ink supply discharge port and the internal pressure regulator; and a capillary structure disposed within the ink reservoir for maintaining a sufficient negative pressure within said ink reservoir to prevent ink drool from said discharge port when the ink supply is disconnected from the printhead, yet which is not so negative that the internal pressure regulator cannot draw ink from it at rates required by the printhead for good quality printing.

25. The ink supply of claim 24 wherein the capillary structure maintains said negative pressure within said ink reservoir in a range between −1 inches of water and −10 inches of water at said discharge port.

26. The ink supply of claim 24 wherein said capillary structure including at least one continuous fiber defining a three dimensional porous member with the at least one continuous fiber bonded to itself at points of contact to form a self sustaining structure for retaining the ink.

* * * * *